US006904901B2

(12) United States Patent
Mitchell

(10) Patent No.: US 6,904,901 B2
(45) Date of Patent: Jun. 14, 2005

(54) AIR-POWERED PROJECTILE LAUNCHER

(76) Inventor: Jeffrey R. Mitchell, 7764 Bass Ridge Trail, Tallahassee, FL (US) 32312

( * ) Notice: Subject to any disclaimer, the term of this patent is extended or adjusted under 35 U.S.C. 154(b) by 106 days.

(21) Appl. No.: 10/601,967

(22) Filed: Jun. 23, 2003

(65) Prior Publication Data

US 2004/0255921 A1 Dec. 23, 2004

(51) Int. Cl.[7] ..... F41B 11/12
(52) U.S. Cl. ..... 124/65; 124/70
(58) Field of Search ..... 124/65, 70

(56) References Cited

U.S. PATENT DOCUMENTS

| | | | | | |
|---|---|---|---|---|---|
| 931,553 | A | | 8/1909 | Allen | |
| 1,171,197 | A | | 2/1916 | Harman, Jr. | |
| 2,293,957 | A | * | 8/1942 | Wells | 124/69 |
| 2,375,607 | A | | 5/1945 | Wulfert | |
| 2,505,428 | A | * | 4/1950 | Pope | 124/65 |
| 2,528,462 | A | * | 10/1950 | Wells | 124/61 |
| 2,594,240 | A | * | 4/1952 | Wells | 124/76 |
| 2,601,555 | A | | 6/1952 | Pope | |
| 2,749,902 | A | * | 9/1956 | Foster | 124/65 |
| 2,762,356 | A | * | 9/1956 | Foster | 124/65 |
| 5,058,561 | A | | 10/1991 | Starr | |
| 5,267,549 | A | | 12/1993 | Webber | |
| 5,377,655 | A | * | 1/1995 | Arad | 124/65 |
| 5,377,656 | A | * | 1/1995 | Lewinski et al. | 124/65 |
| 5,381,928 | A | * | 1/1995 | Lee et al. | 222/79 |
| 5,735,256 | A | | 4/1998 | Monk | |
| 6,067,975 | A | * | 5/2000 | Ginn | 124/59 |
| 6,250,294 | B1 | | 6/2001 | Lim | |
| 6,408,837 | B1 | | 6/2002 | Johnson et al. | |

* cited by examiner

*Primary Examiner*—Michael J. Carone
*Assistant Examiner*—Troy Chambers
(74) *Attorney, Agent, or Firm*—John Wiley Horton

(57) ABSTRACT

An air-powered projectile launcher. A double-acting piston within a pump tube is employed. A separate magazine tube is used to hold a plurality of projectiles. One end of the magazine tube feeds into a barrel assembly. The opposite end is closed by a one-way valve. The muzzle of the barrel is closed by a muzzle valve. When the piston is pulled through a back stroke, an air manifold directs the flow to induce a vacuum in the end of the magazine tube proximate the barrel. The vacuum closes the muzzle valve and opens the one-way valve on the opposite end of the magazine tube. The vacuum then pulls the first projectile into the barrel. When the piston is pushed through a forward stroke, pressure is directed behind the first projectile and in front of the second projectile. The second projectile is forced back into the magazine tube. The pressure within the magazine tube closes the one-way valve, effectively making the second projectile the base of a closed firing chamber. As the piston continues through its forward stroke, the first projectile is forced through the barrel. The muzzle valve flies open and the first projectile shoots out at substantial velocity. The piston is then ready for a new back stroke, which repeats the cycle.

7 Claims, 14 Drawing Sheets

AIR-POWERED PROJECTILE LAUNCHER

BACKGROUND OF THE INVENTION

1. Field of the Invention.

This invention relates to the field of small projectile launchers. More specifically, the invention comprises an air-powered launcher capable of individually feeding and shooting pliable objects such as marshmallows and foam ear plugs.

2. Description of the Related Art

Small projectile launchers have long been known as novelty items. These launchers typically fire potatoes, vegetable slices, marshmallows, tennis balls, and the like. Some are spring loaded, while others use pistons to compress a charge of air. They typically fire a small projectile which can be used in "mock combat" games without actually injuring the target. These devices have also found application other than as novelty items. Some have been used to fire marking projectiles in the veterinary and timber industries. Others have been used as pill injectors for treating horses and cows. Thus, although such projectile launchers are most often viewed as novelty items, their applications may be much broader.

BRIEF SUMMARY OF THE PRESENT INVENTION

The present invention comprises an air-powered projectile launcher. A double-acting piston within a pump tube is employed. A separate magazine tube is used to hold a plurality of projectiles. One end of the magazine tube feeds into a barrel assembly. The opposite end is closed by a one-way valve. The muzzle of the barrel is closed by a muzzle valve. When the piston is pulled through a back stroke, an air manifold directs the flow to induce a vacuum in the end of the magazine tube proximate the barrel. The vacuum closes the muzzle valve and opens the one way valve on the opposite end of the magazine tube. The vacuum then pulls the first projectile into the barrel.

When the piston is pushed through a forward stroke, pressure is directed behind the first projectile and in front of the second projectile. The second projectile is forced back into the magazine tube. The pressure within the magazine tube closes the one way valve, effectively making the second projectile the base of a closed firing chamber. As the piston continues through its forward stroke, the first projectile is forced through the barrel. The muzzle valve flies open and the first projectile shoots out at substantial velocity. The piston is then ready for a new back stroke, which repeats the cycle.

REFERENCE NUMERALS IN THE DRAWINGS

| | |
|---|---|
| 10 | projectile gun |
| 12 | magazine tube |
| 14 | pump tube |
| 16 | slide |
| 18 | cross pin |
| 20 | pin slot |
| 22 | tube bracket |
| 24 | handle |
| 26 | manifold |
| 28 | barrel assembly |
| 30 | muzzle |
| 32 | muzzle valve |
| 34 | bore |
| 36 | breach receiver |
| 38 | piston |
| 40 | connecting rod |
| 42 | magazine outlet |
| 44 | one-way valve |
| 46 | barrel |
| 48 | breach plug |
| 50 | throat |
| 52 | air hole |
| 54 | feeding cone |
| 56 | pressure chamber |
| 58 | feeding tube |
| 60 | sealing ring |
| 62 | valve slot |
| 64 | follower |
| 66 | vent |
| 68 | feed plenum |
| 70 | projectile |
| 72 | first projectile |
| 74 | second projectile |
| 76 | retaining clip |
| 78 | detachable magazine |
| 80 | magazine sealer |
| 82 | magazine receiver |
| 84 | one piece barrel |
| 86 | sealing ring |

DETAILED DESCRIPTION OF THE INVENTION

Figure 1:
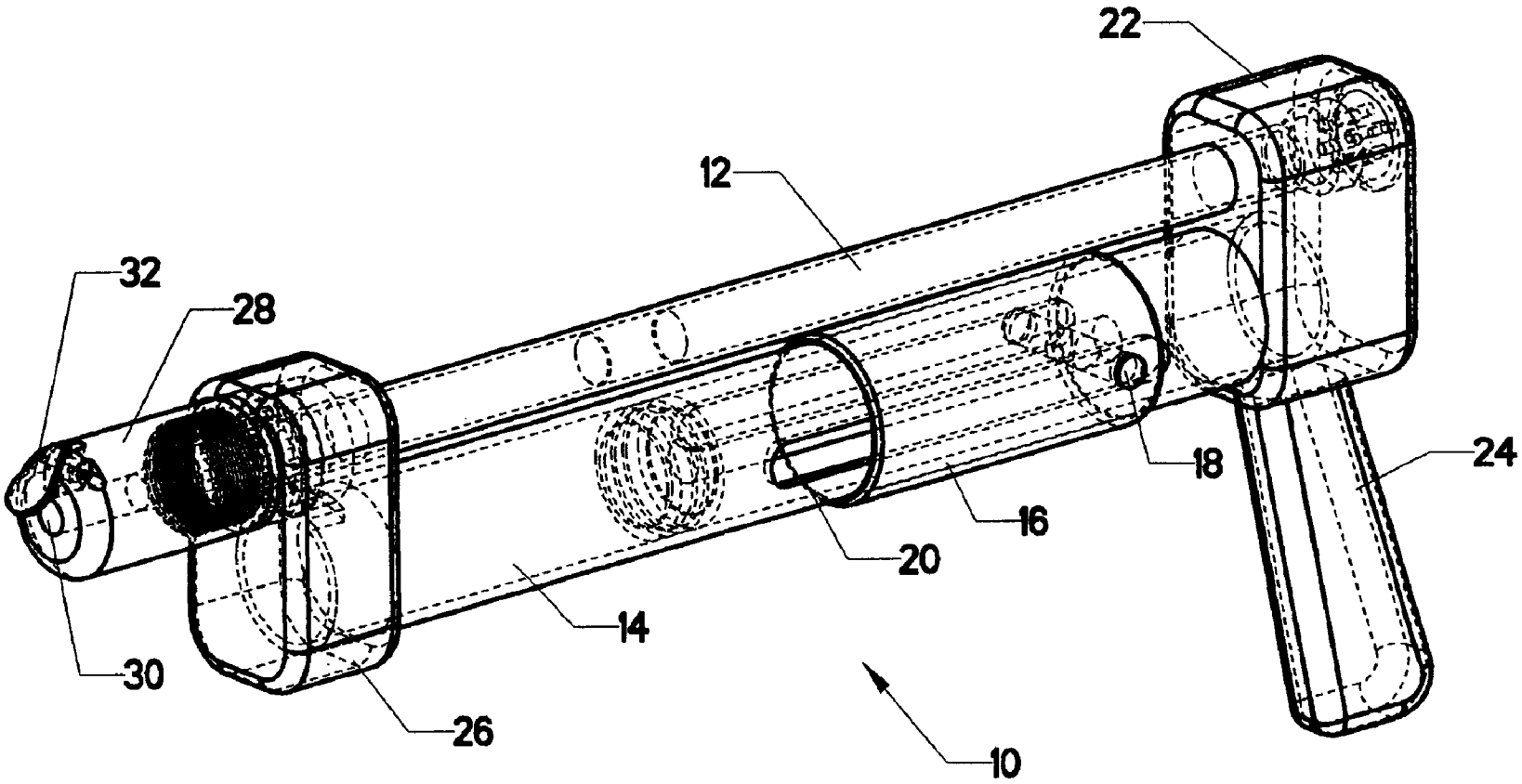
FIG. 1 is a perspective hidden line view, showing the present invention.

FIG. 1 shows a hidden line view of projectile gun 10. Magazine tube 12 and pump tube 14 are held in position by manifold 26 and tube bracket 22. Slide 16 slide forward and backward along pump tube 14. Cross pin 18—which is connected to an internal piston, rests within pin slot 20. Pin slots the forward and backward travel of slide 16.

Handle 24 is provided on the lower portion of tube bracket 22. Barrel assembly 28 is attached to manifold 26. Muzzle 30 is regulated by muzzle valve 32. The projectiles to be fired by the device are stored in magazine tube 12. The user charges the device by pulling slide 16 to its rearward limit.

When the user then pushes slide 16 forward, a projectile will be expelled from muzzle 30. Each cycling of slide 16 loads and fires a single projectile.

Figure 2:
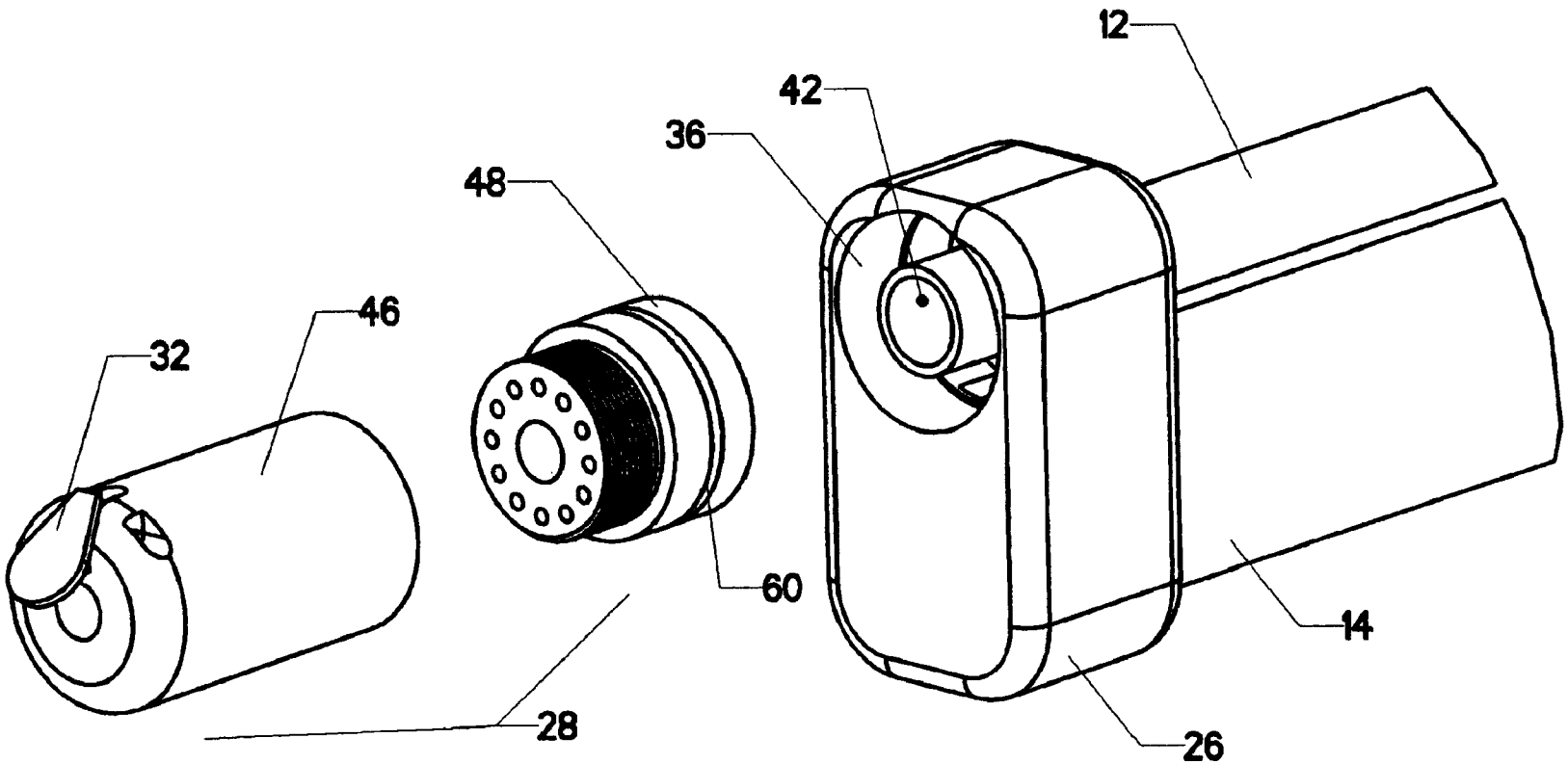
FIG. 2 is an exploded detail view, showing how the barrel mounts to the manifold.

FIG. 2 shows barrel assembly 28 removed from manifold 26 and in an exploded state. Breach plug 48 fits into breach receiver 36, with sealing ring 60 forming an airtight seal. The forward end of magazine tube is open (magazine outlet 42). Barrel 46 threads onto the forward portion of breach plug 48. Muzzle valve 32 is pivotally mounted to barrel 46.

Figure 3:
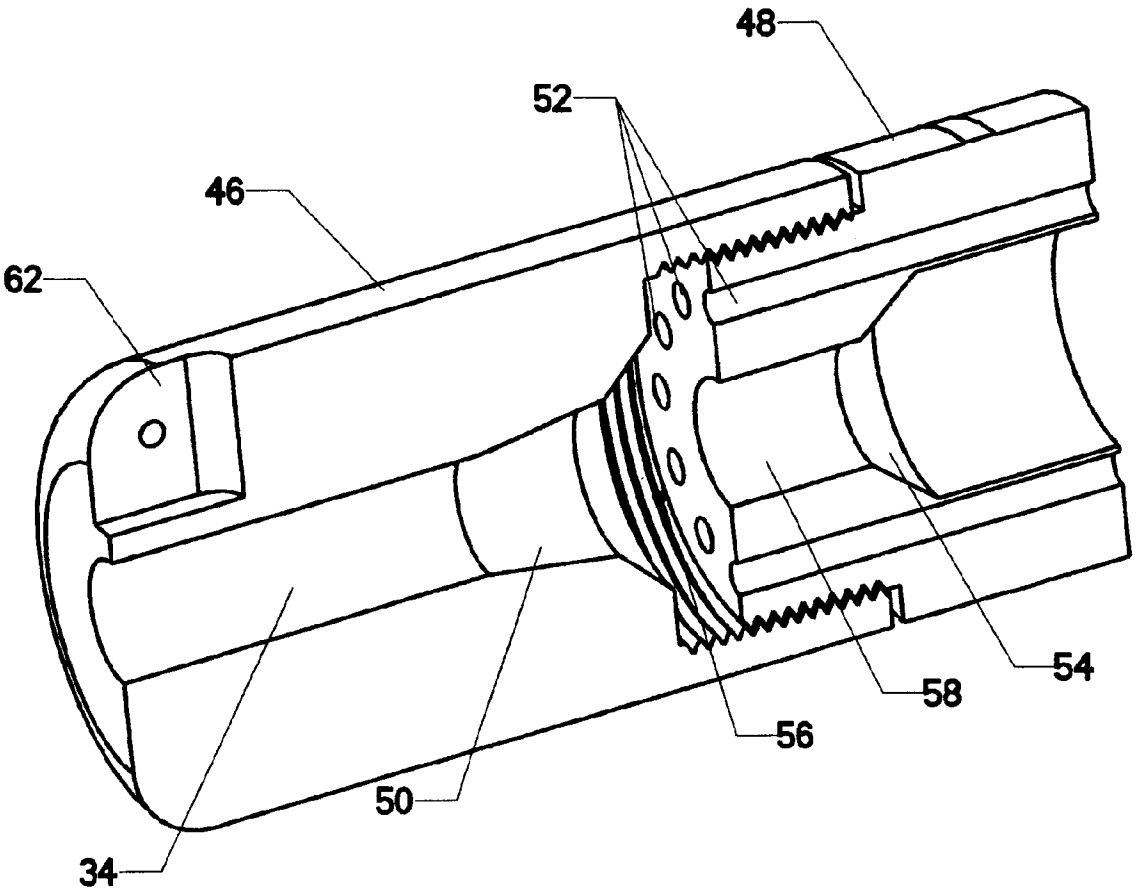
FIG. 3 is a section view, showing the barrel's internal details.

FIG. 3 is a section view through breach plug 48 and barrel 46 (with the two components being assembled). Referring to both FIGS. 2 and 3, magazine outlet 42 fits inside breach plug 48, adjacent to feeding cone 54. The projectiles are fed through this assembly from right to left in the view as shown. Feeding cone 54 narrows to feeding tube 58. Feeding tube 58 leads into pressure chamber 56. Pressure chamber 56, in turn, leads to throat 50. Bore 34 is connected to throat 50.

The two components are threaded together, though the actual method of joinder is not significant. A series of radially spaced air holes 52 pass through breach plug 48. These apply pressure and vacuum forces to pressure chamber 56, as will be described subsequently. Valve slot 62 is provided to attach muzzle valve 32.

Figure 4:
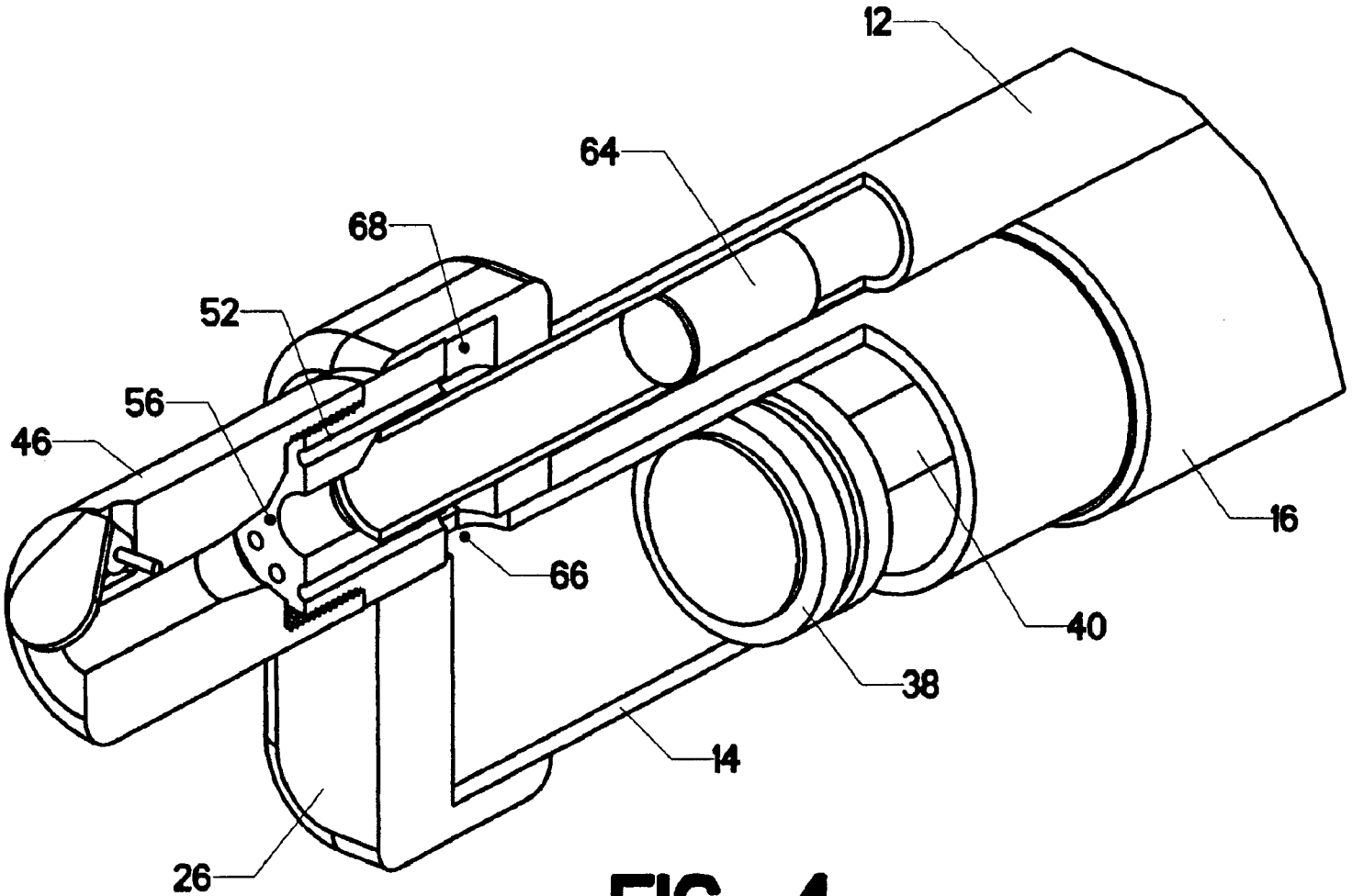
FIG. 4 is a section view, showing some internal passages.

FIG. 4 is a section view through the assembled projectile gun. The reader will observe how breach plug 48 fits within manifold 26. The forward end of pump tube 14 is sealed by manifold 26. Vent 66 is cut into the top of pump tube 14, however. Vent 66 feeds into feed plenum 68, a hollow cavity within manifold 28. Returning briefly to FIG. 2, feed plenum 68 is readily visible. Breach plug 48 actually seats against a step-down in the bore through manifold 26 (visible as a ring in FIG. 2). The reader will observe that feed plenum 68 completely surrounds magazine tube 12.

Returning now to FIG. 4, the purpose of air holes 52 will be explained. Piston 38 moves forward and backward within pump tube 14, since it is connected to slide 16. As it moves forward, air is pushed through vent 66 into feed plenum 68. It then flows through air holes 52 and pressurizes pressure chamber 56. The reverse is also true—When piston 38 moves backward, a vacuum is created within pressure chamber 56.

Follower 64 is a free-sliding plug within magazine tube 12. The rearward end of magazine tube 12 is closed by a one-way valve which allows air to flow into, but not out of, the rear of magazine tube 12.

Figure 5:
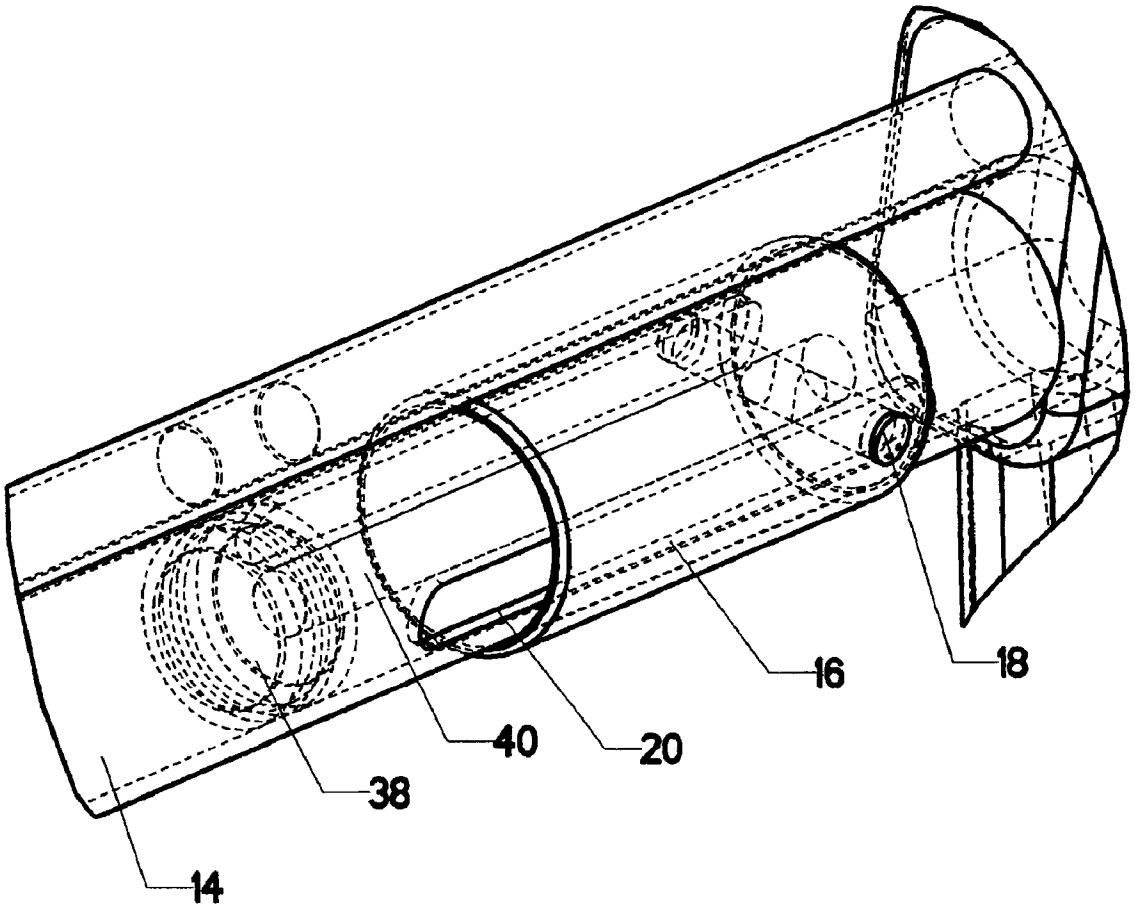
FIG. 5 is a hidden line detail view, showing the connections to the piston.

FIG. 5 illustrates the connections between slide 16 and piston 38. Piston 38 is attached to connecting rod 40. Connecting rod 40 is pierced by a transverse hole, as is slide 16. Cross pin 18 is located in the transverse hole through connecting rod 40 and slide 16. It is retained via friction, adhesive, clips, or other known devices. Cross pin 18, as mentioned previously, also rests within pin slot 20. Thus, when the user graps slide 16 and moves it forward or backward, piston 38 will move likewise.

Figure 6:
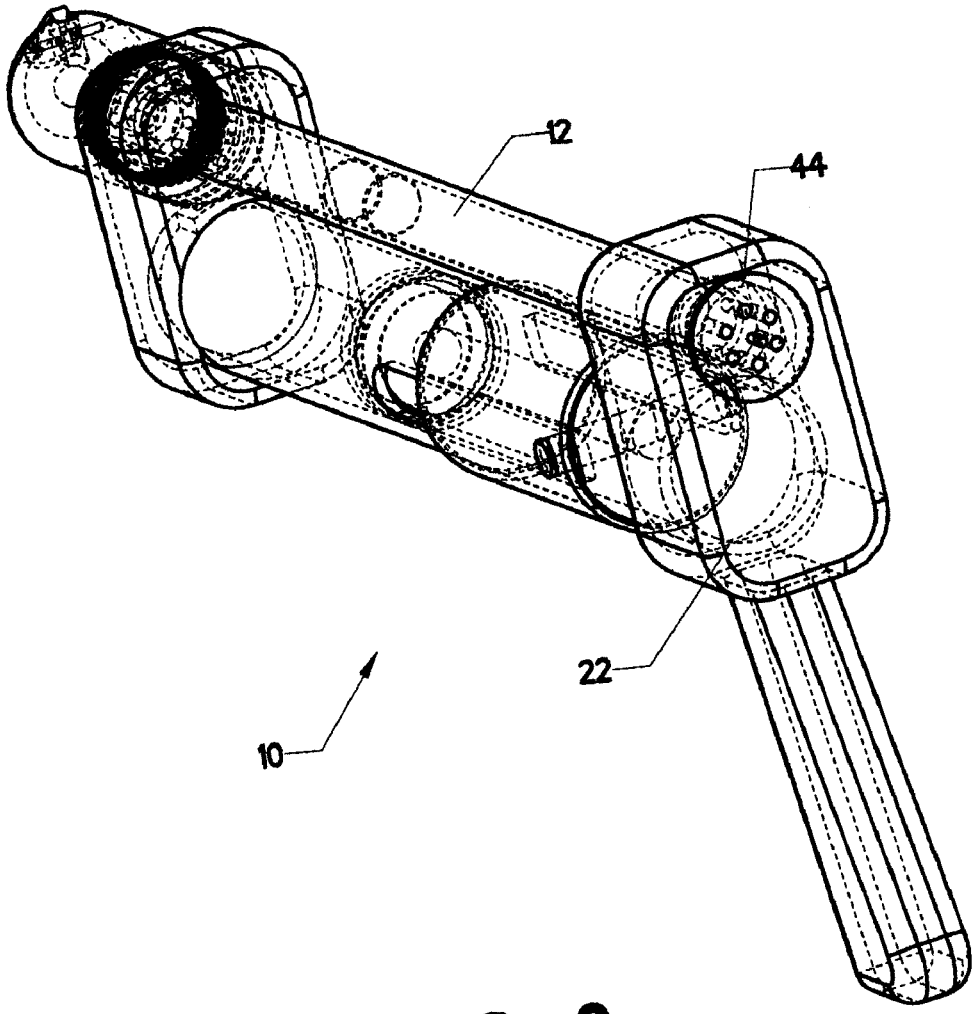
FIG. 6 is a hidden line perspective view, showing the location of the one way valve.

FIG. 6 shows a rear view of projectile gun 10. Tube bracket 22 is used to mount one-way valve 44, which closes off the rear end of magazine tube 12.

Figure 7:
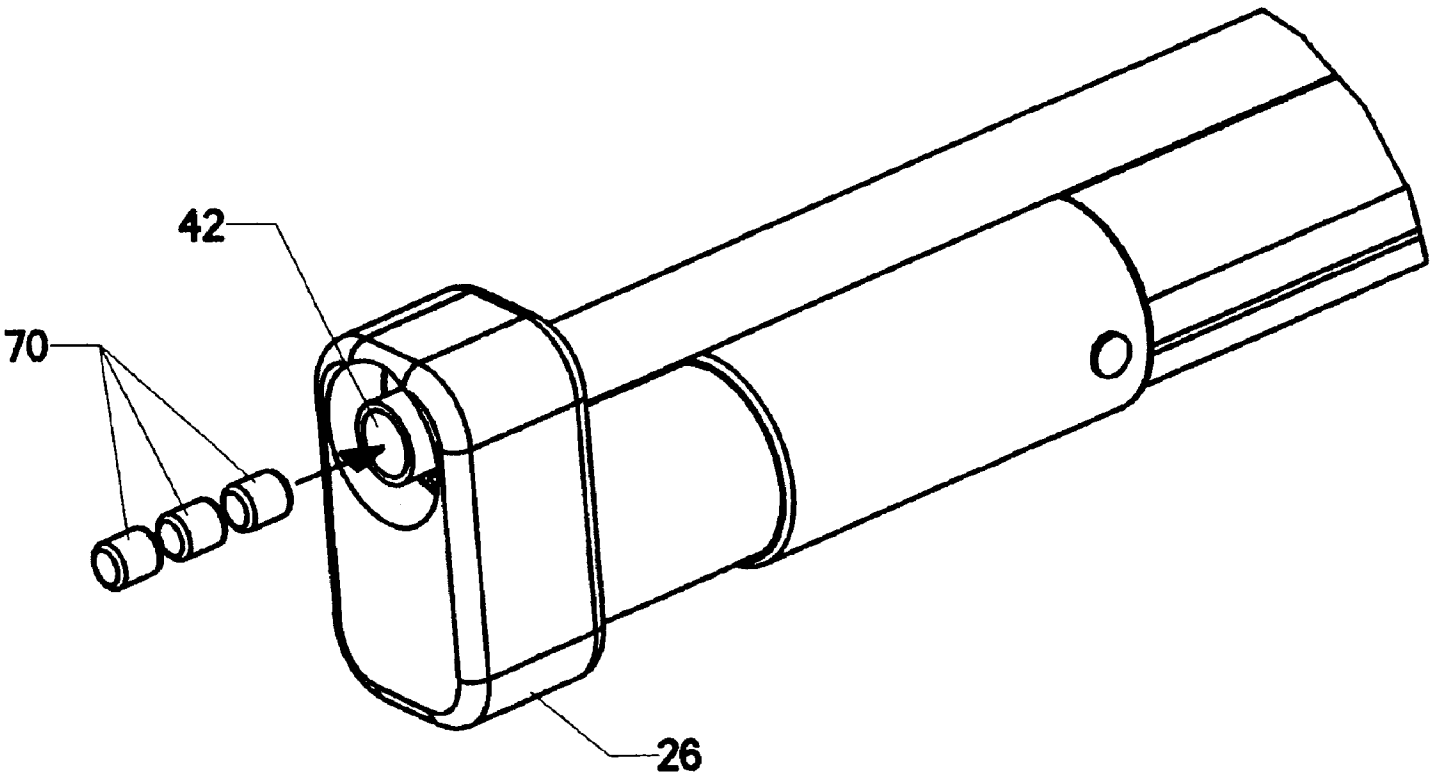
FIG. 7 is a detail view, showing the loading of the magazine.

FIGS. 7–10 illustrate the operation of the device. In FIG. 7, barrel assembly 28 has been removed to expose magazine outlet 42. One or more projectiles 70 are pushed into magazine outlet 42 and into magazine tube 12. Projectiles 70 should be somewhat pliable. Small marshmallows and foam ear plugs are good examples of suitable projectiles.

Figure 8:
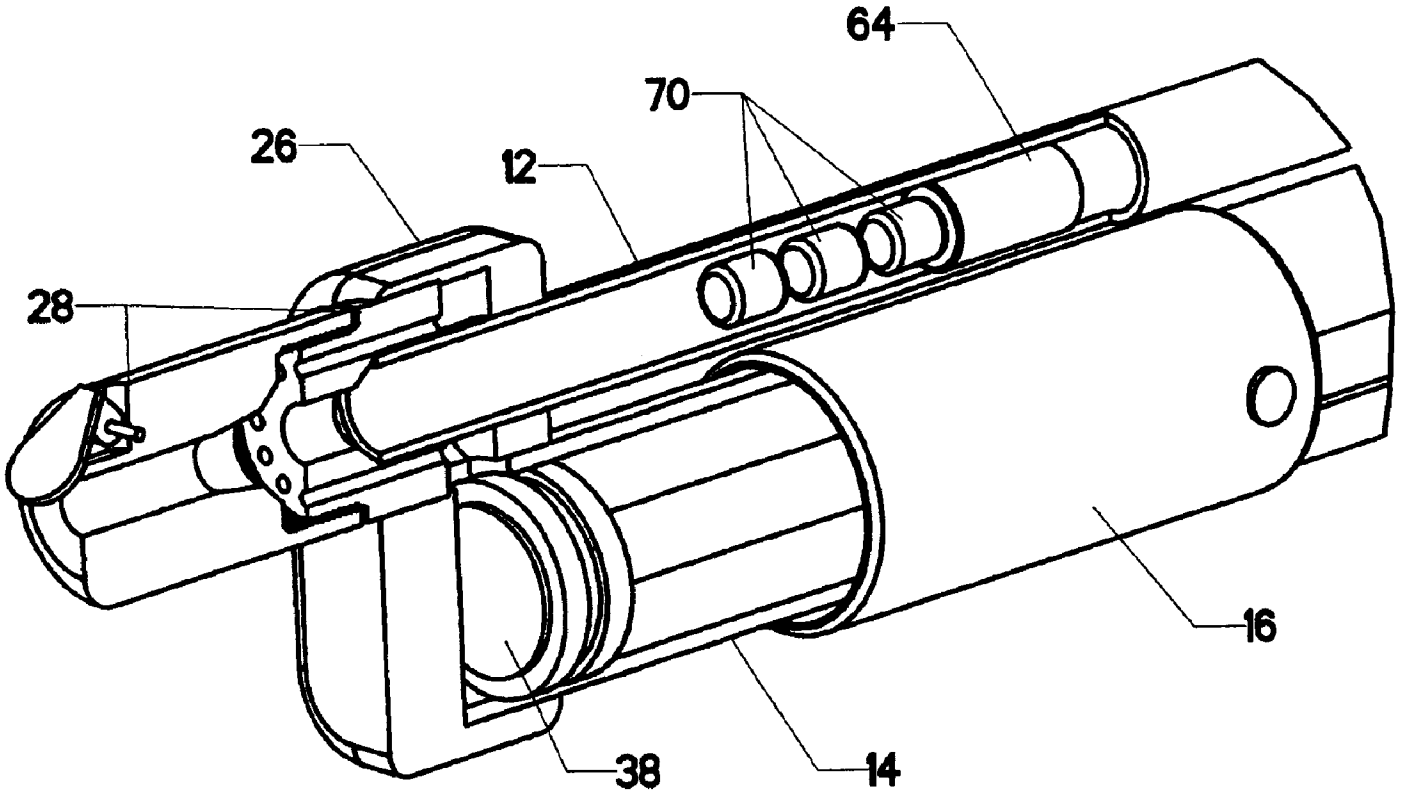
FIG. 8 is a section view, showing the firing cycle.

Once the desired number of projectiles has been loaded, the user replaces barrel assembly 28 as shown in FIG. 8. Barrel assembly 28 may be fitted by simply pressing it into manifold 26 (conventional latching features may also be used to retain it). Follower 64 lies to the rear of projectiles 70 within magazine tube 12.

Figure 9:
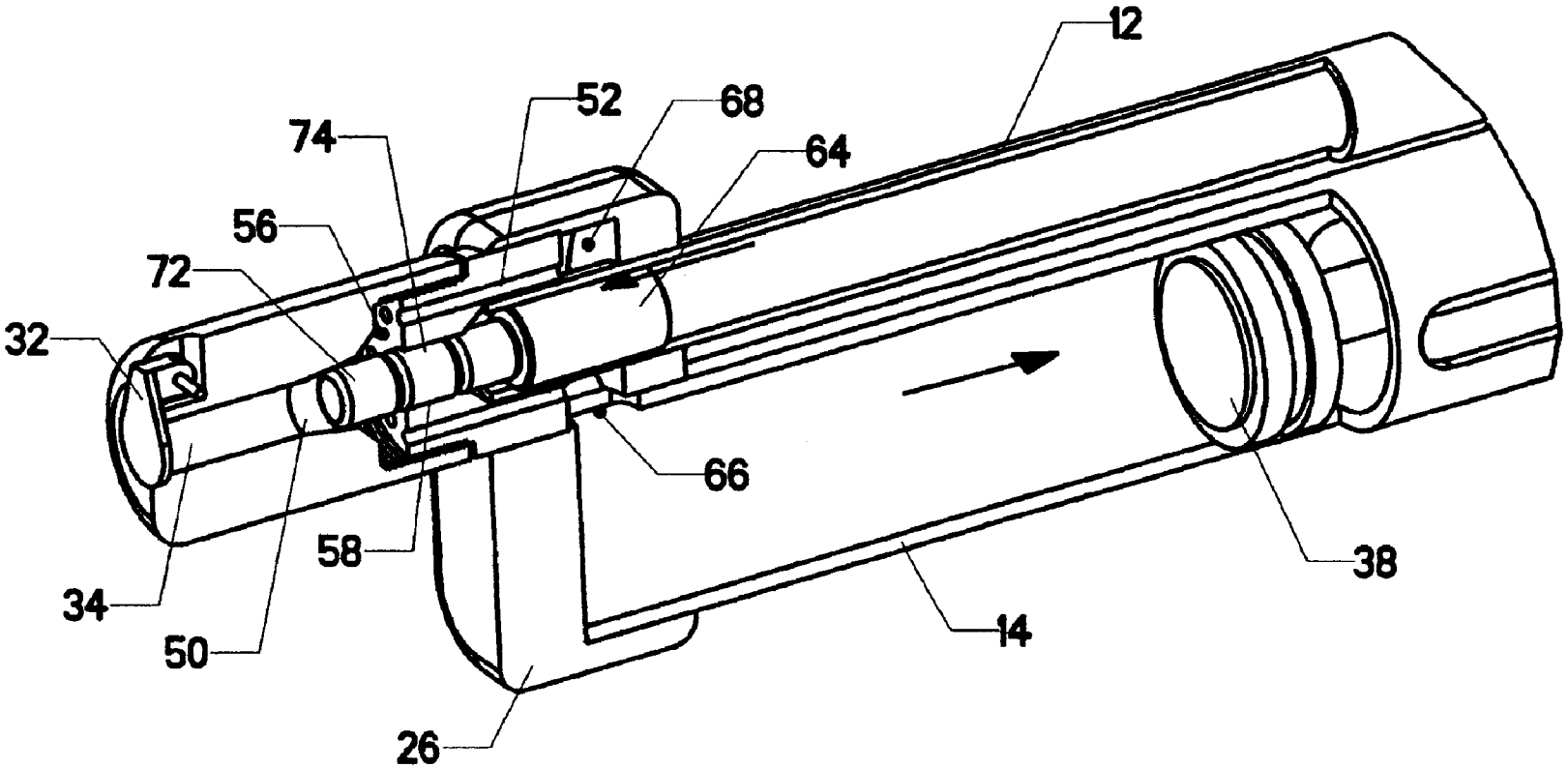
FIG. 9 is a section view, showing the firing cycle.

To prepare the device for firing, the user first grabs slide 16 and pulls it rearward. FIG. 9 shows this action, with piston 38 nearing the end of its rearward stroke. A vacuum is created within the forward portion of pump tube 14. This vacuum is carried through vent 66, feed plenum 68, air holes 52, and into pressure chamber 56. The vacuum pulls muzzle valve 32 closed. One-way valve 44, in the rear of magazine tube 12 opens to admit air into the magazine tube, behind follower 64. Follower 64 then moves forward, pushing the projectiles along, until first projectile 72 is lodged in throat 50 (It is stopped by the narrowing diameter of throat 50). Second projectile 74 rests within feeding tube 58.

Figure 10:
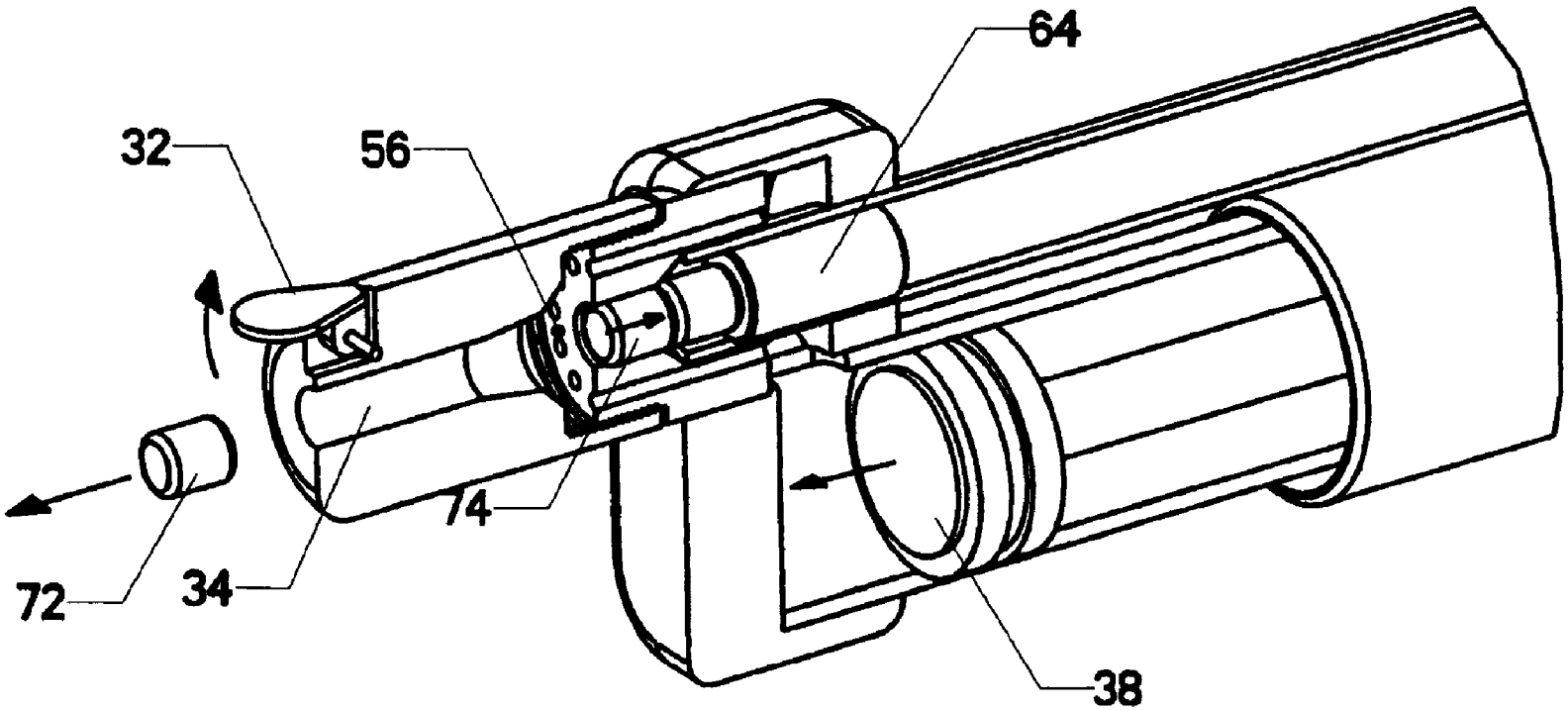
FIG. 10 is a section view, showing the firing cycle.

FIG. 10 shows the forward stroke of piston 38. High pressure is created within pressure chamber 56. This pressure forces second projectile 74 back into feeding tube 58 (using all the remaining projectiles against follower 64). One-way valve 44 will not allow air to escape from the rear of magazine tube 12. Thus, the remaining projectiles and follower 64 effectively become a rearward wall of pressure chamber 56. Since the pressure has nowhere else to go, first projectile 72 is compressed into throat 50 and down bore 34. Air compression in front of first projectil 72 opens muzzle valve 32. First projectile 72 then shoots out at considerable velocity.

Once piston 38 reaches the forward limit of its stroke, the cycle is set to repeat. When the piston is again cycled rearward, the configuration shown in FIG. 9 will recur. Thus, those skilled in the art will realize that each cycle of the piston, shoots one of the projectiles in magazine tube 12.

Figure 11:
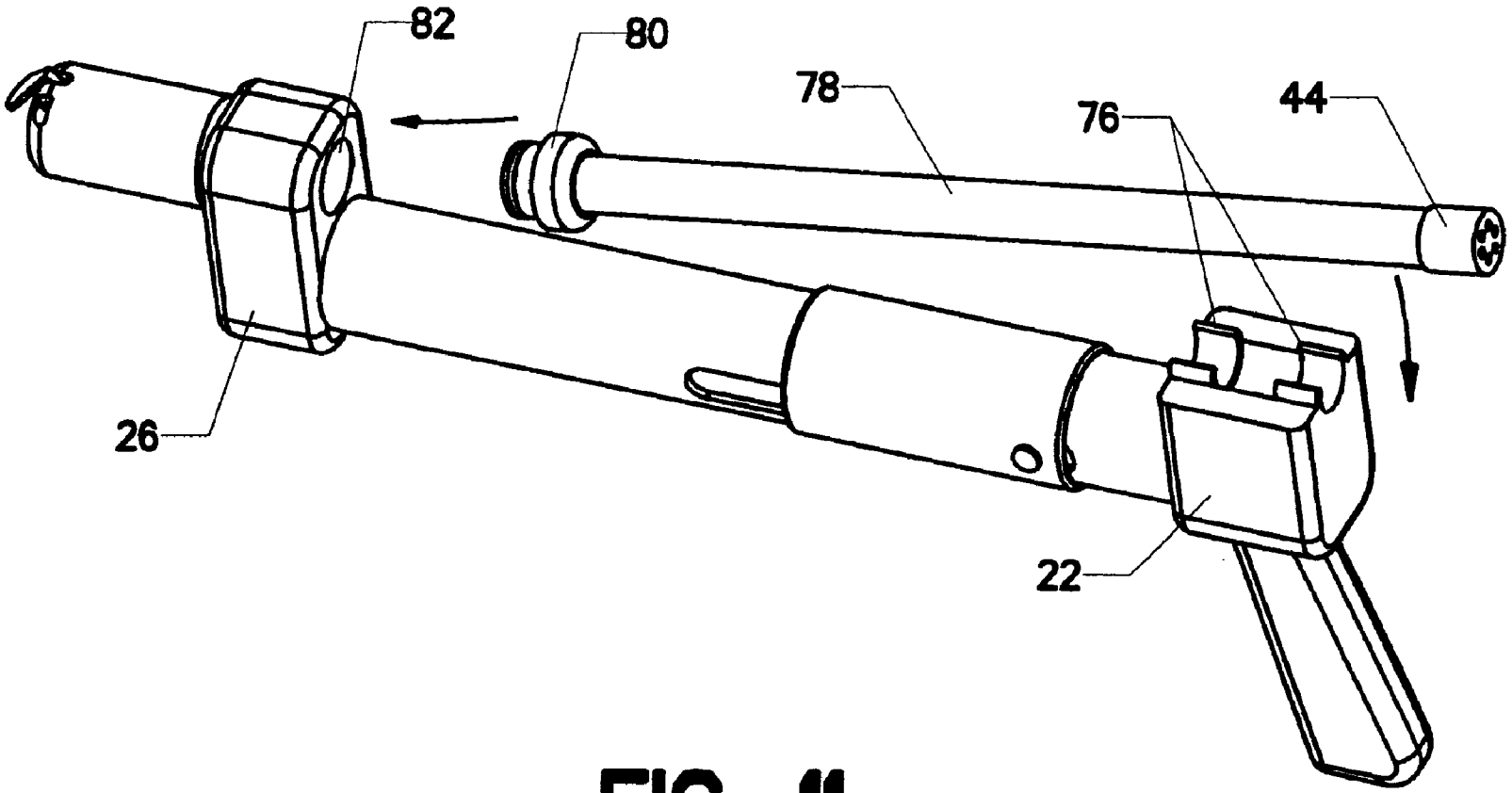
FIG. 11 is a perspective view, showing a variant having a detachable magazine.

The loading process illustrated in FIG. 7 is effective but not very rapid. Some users may desire the immediate reloading of a full magazine. FIG. 11 depicts a variant including a detachable magazine. Manifold 26 is modified to include magazine receiver 82. Detachable magazine 78 includes magazine sealer 80 affixed to its forward extreme. Detachable magazine 78 is loaded with projectiles. A follower 64 and one-way valve 44 are also provided.

To reload the device, the user presses the forward end of detachable magazine 78 into magazine receiver 82 and rotates the rearward end down into retaining clips 76 provided on the top of tube bracket 22. Magazine sealer 80 provides an airtight seal with manifold 26. The internal passages and connections within manifold 26 may be the same as illustrated previously, though the dimensions will vary to accommodate the addition of magazine sealer 80.

Thus, to reload the weapon, the user attaches detachable magazine 78. The user may need to cycle slide 16 to advance the first projectile to firing position. The user then fires the device normally. Several detachable magazines 78 can be carried for quick reloading.

Figure 12:
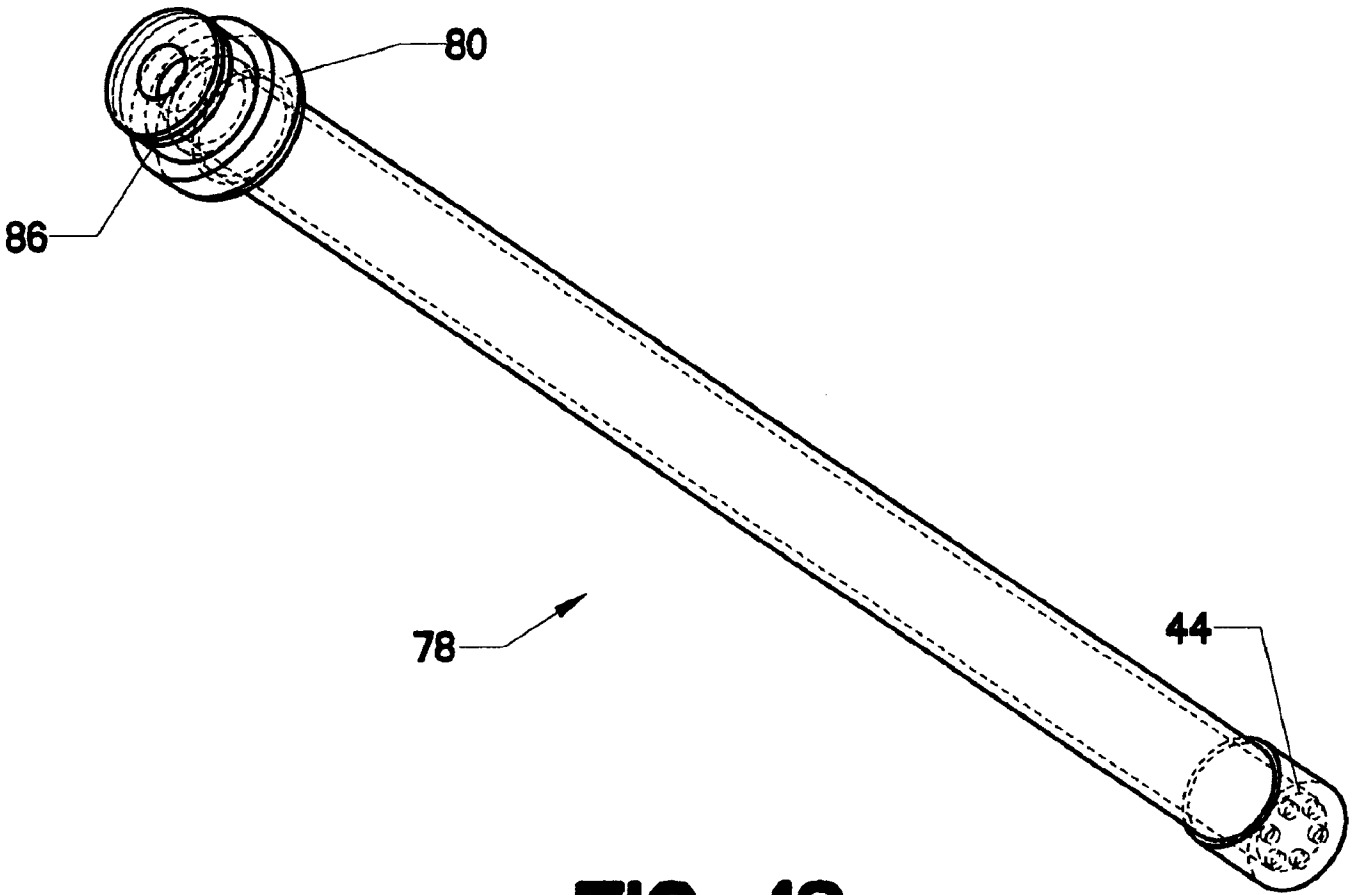
FIG. 12 is a perspective view, showing the detachable magazine in more detail.
Figure 13:
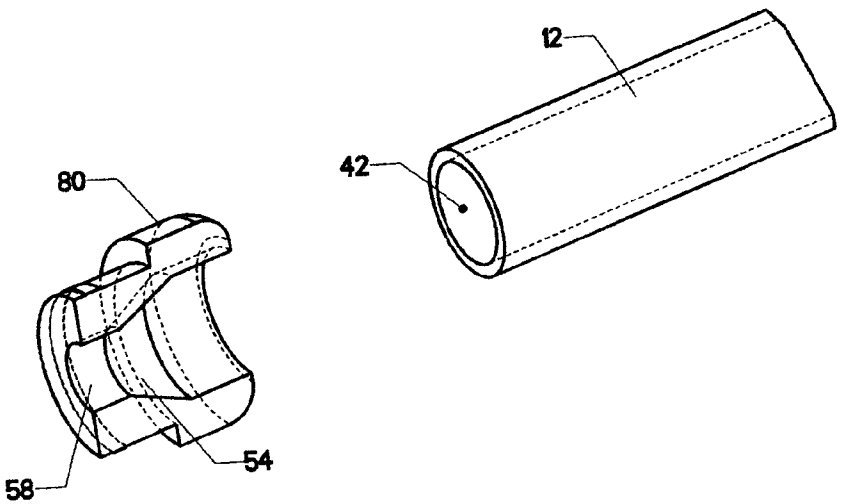
FIG. 13 is a perspective view with a section, showing how the magazine sealer can be detached from the magazine tube.
Figure 14:
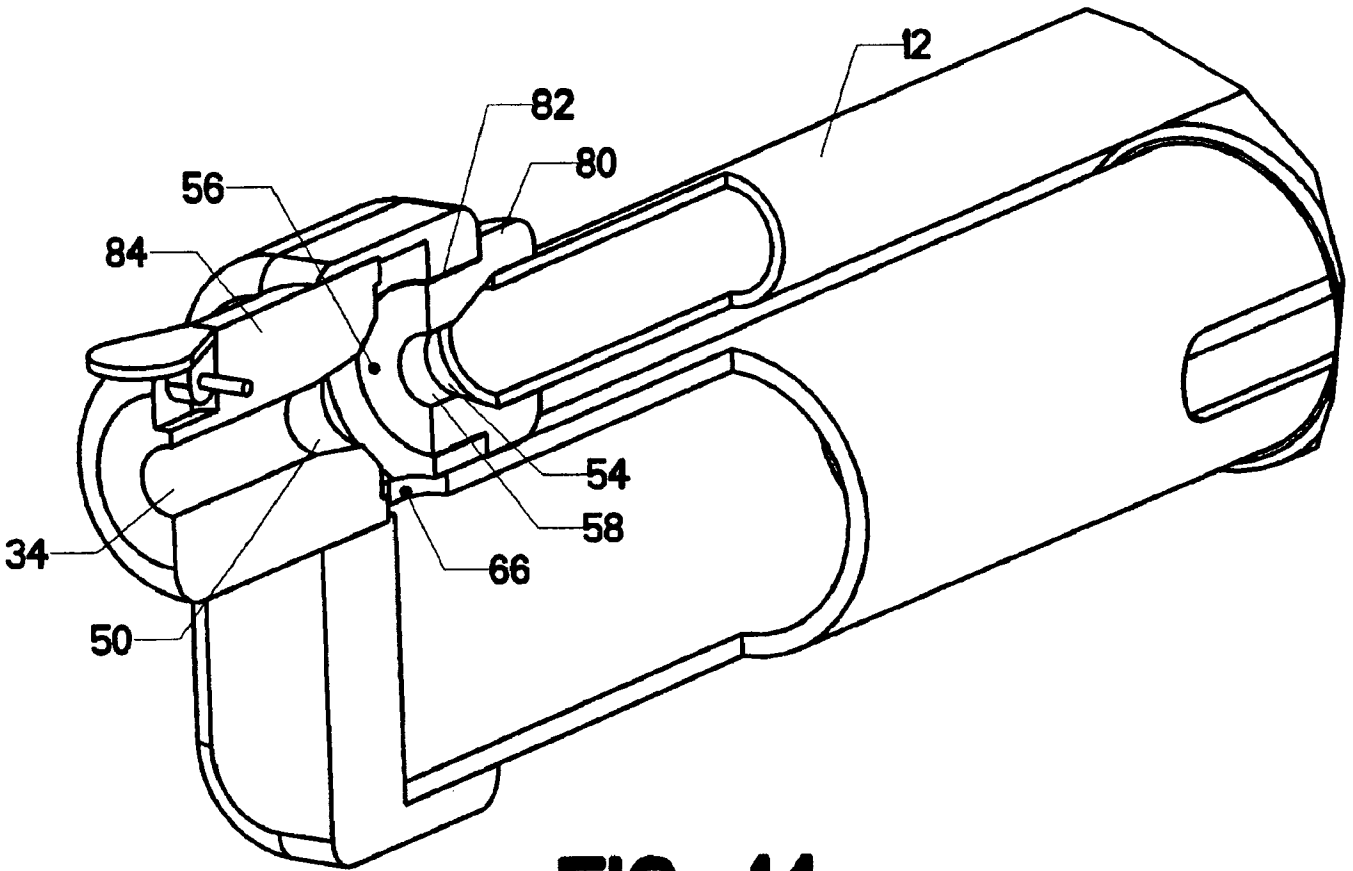
FIG. 14 is a section view, showing the internal details of the detachable magazine version.

Although the preceding descriptions contain significant detail they should not be viewed as limiting the invention but rather as providing examples of the preferred embodiments of the invention. As one example, vent 66 could be configured to feed directly into pressure chamber 56 rather than through feed plenum 68. The principles governing the operation of the device would be the same. FIGS. 12–14 depict this variation (also including the use of a detachable magazine and a one-piece barrel assembly). FIG. 12 shows detachable magazine 78 in more detail. It includes a feed tube with one way valve 44 closing one end. Magazine sealer 80 is removably mounted on the opposite end. Magazine sealer 80 includes a pliable sealing ring 86, which seals the assembly to magazine receiver 82 in manifold 26.

In order to allow quick loading of detachable magazine 78, magazine sealer 80 is detachable. FIG. 13 shows the assembly with magazine sealer 80 detached. Magazine outlet 42 is exposed for rapid loading. Magazine sealer 80 is sectioned in the view to allow the visualization of its internal features. The reader will observe that it includes internal features previously found in breach plug 48 (feeding cone 54 and feeding tube 58).

FIG. 14 shows detachable magazine 78 in position within the projectile launcher, with a section through the assembly to expose the internal details. Breach plug 48 has been eliminated. Vent 66 feeds directly into the area immediately behind one piece barrel 84 (pressure chamber 56). The linear progression through feeding cone 54, feeding tube 58, pressure chamber 56, throat 50, and bore 34 is the same as for the previously disclosed embodiments. Thus, the function of feeding and firing the projectiles is identical. However, the device has been simplified. It also permits the use of a detachable magazine.

Those skilled in the art will realize that many such structural variations are possible without altering the operating principles of the invention. Accordingly, the scope of the invention should be determined by the following claims, rather than the examples given.

Having described my invention, I claim:

1. A projectile gun allowing a user to shoot a plurality of projectiles including a first projectile, comprising:

a. a magazine tube for containing said plurality of projectiles, wherein said magazine tube has a first end and a second end;

b. a one-way valve closing said second end of said magazine tube, wherein said one-way valve allows air to flow into said magazine tube but does not allow air to flow out of said magazine tube;

c. a pressure chamber attached to said first end of said magazine tube;

d. a bore, having a first end and a second end, wherein said first end is attached to said pressure chamber in a position distal to said magazine tube;

e. a muzzle valve, covering said second end of said bore, wherein said muzzle valve allows air to flow out of said bore but does not allow air to flow into said bore;

f. a pump tube;

g. a piston within said pump tube; and h. a connection between said pump tube and said pressure chamber, so that when said piston is pulled away from said connection, a vacuum is created within said pressure chamber which pulls said first projectile into said bore, and so that when said piston is then moved toward said connection, pressure is created within said pressure chamber, thereby shooting said first projectile through said bore and out of said projectile gun.

2. A projectile gun as recited in claim 1, further comprising a follower slidably mounted within said magazine tube between said projectiles and said one-way valve.

3. A projectile gun as recited in claim 1, wherein said magazine tube is detachable.

4. A projectile gun as recited in claim 1, wherein said bore is detachable in order to expose said first end of said magazine tube in order to load said plurality of projectiles.

5. A projectile gun as recited in claim 1, wherein said muzzle valve is a flap biased toward the closed position.

6. A projectile gun as recited in claim 1, further comprising a slide, connected to said piston, which provides a gripping point for said user to manipulate said piston.

7. A projectile gun as recited in claim 1, further comprising a handle which allows said user to more easily grasp said projectile gun.

* * * * *